United States Patent [19]

Hansen

[11] Patent Number: 4,618,290

[45] Date of Patent: Oct. 21, 1986

[54] PRECAST ROOF BEARING BLOCK

[76] Inventor: Roger M. Hansen, 1544 Panorama Dr., Birmingham, Ala. 35216

[21] Appl. No.: 507,748

[22] Filed: Jun. 27, 1983

[51] Int. Cl.[4] ..... E21D 21/00

[52] U.S. Cl. ..... 405/259; 405/288

[58] Field of Search ..... 405/255, 259–262, 405/288; 52/165, 166; 411/531

[56] References Cited

U.S. PATENT DOCUMENTS

| | | | |
|---|---|---|---|
| 1,433,621 | 10/1922 | Hutton | 52/166 |
| 1,528,056 | 6/1924 | Herbert . | |
| 2,682,152 | 6/1954 | Bierer | 61/45 |
| 3,111,655 | 11/1963 | Kotarsky et al. | 340/213 |
| 3,224,202 | 12/1965 | Durget | 61/45 |
| 3,300,918 | 1/1967 | Maule | 52/103 |
| 3,415,064 | 12/1968 | Talobre | 61/45 |
| 3,521,454 | 7/1970 | Dodds | 61/45 |
| 4,112,693 | 9/1978 | Collin et al. | 405/132 |
| 4,307,979 | 12/1981 | Killmeyer | 405/259 |
| 4,325,657 | 4/1982 | Elders | 405/259 |

FOREIGN PATENT DOCUMENTS

| | | | |
|---|---|---|---|
| 1156187 | 5/1958 | France | 405/259 |
| 1304298 | 8/1962 | France | 405/259 |

*Primary Examiner*—David H. Corbin

*Attorney, Agent, or Firm*—Arnold B. Silverman

[57] ABSTRACT

A precast roof bearing block, such as a mine roof bearing block, may have a substantially solid molded body provided with reinforcement. The body has an upper bearing surface and a generally parallel lower bearing surface. A lateral surface connects the upper and lower bearing surfaces. A hole passes through the body member extending from one bearing surface to the other and may be located at the central axis of the body. A first reinforcing member may take the form of an annular ring which is disposed close to the upper bearing surface and a second reinforcing member may take the form of an annular ring which is disposed close to the lower bearing surface. The body member may have a substantially frustoconical or dome shaped configuration. A modified embodiment facilitates angular positioning of the roof bolt.

25 Claims, 11 Drawing Figures

PRECAST ROOF BEARING BLOCK

BACKGROUND OF THE INVENTION

1. Field of the Invention

This invention relates to a precast roof bearing block which is of substantially solid section and may be provided with reinforcing means.

2. Description of the Prior Art

In connection with underground mining activities it has long been known to provide means for securing the mine roof so as to reduce the risk of potentially life threatening cave-ins. It has been known to drill holes in the mine roof and to secure bearing plates by means of elongated roof bolts which are advanced into the drilled holes. As the roof bolt is advanced into the hole, the mine roof bearing plate is urged into intimate contact with the roof surface thereby transmitting a bearing force from the roof bolt head through the bearing plate to the roof to effect compression of the overlying strata. See generally U.S. Pat. Nos. 2,682 152; 3,224,202; 3,415,064; 3,521,454; 4,112,693 and 4,307,979.

It has been known to employ square or rectangular steel plates as bearing plates. One of the problems which has been encountered with such planar plates has been excessive deformation of the plates when load was applied. It has been suggested to provide integral stiffening means within the plates in order to resist undesired deflection under load. See, for example, U.S. Pat. Nos. 3,415,064 and 4,112,693. One of the problems with such constructions is that while the irregularities do serve to strengthen the plates, they result in a substantial reduction of the area of actual contact between the mine roof and the plate which, may be such as to reduce the area of contact by about 35 to 50 percent. Also, sharp edges of the steel plate tend to cut into soft rock if there is an uneven bearing surface. This serves to reduce the effectiveness of the roof support system.

U.S. Pat. No. 2,682,152 discloses a system wherein the grouting material which is introduced in the regions surrounding the anchor bolt is also, by means of a metal form member which remains in place, molded around the exterior of the roof hole. There is further provided a steel member which serves to resist the initial clamping load. As a result of the manner in which this construction is assembled the sharp edges of the channel member will tend to embed in the rock and consequentially a significant portion of the clamp load will be lost before the grouted material can harden. A further problem is that as a result of the need for the cap member to harden, a major portion of the clamp load will be lost allowing roof rock to sag, and, perhaps, fail prematurely, even before such solidification occurs. Finally, this patent requires special equipment to mix and place the grout.

There remains, therefore, a very significant need for a mine roof bearing block which will effectively establish the desired clamping preload so as to resist undesired deformations or cave-ins of mine roofs.

SUMMARY OF THE INVENTION

The present invention has met the above-described need by providing a unique form of substantially rigid precast mine roof bearing block. A substantially solid molded block is provided with generally parallel upper and lower bearing surfaces with the mine roof contacting bearing surface being the larger of the two. A hole extends through the body to permit passage of a roof bolt therethough in order to provide a clamping action to the overlying rock strata. Specifically configurated and positioned reinforcing means are provided. The bearing surfaces are so sized as to effect the desired transfer of bearing load through the solid body.

The reinforcing means, in one form includes an annular steel band which serves to provide tensile strength, while the molded material provides strength in compression. The molding process creates a self-bonded unity between the molded material and the reinforcing means.

It is an object of the present invention to provide an improved precast mine roof bearing block which will efficiently and economically secure a roof bolt.

It is another object of the present invention to provide such a precast bearing block which may be employed with conventional mine equipment and procedures.

It is another object of the present invention to provide such a bearing block wherein uniquely configurated and positioned reinforcing means are provided so as to establish maximum strength for the bearing block for various load conditions.

It is another object of the present invention to provide such bearing blocks which have geometrically efficient shapes in respect of load transmission characteristics.

It is yet another object of the present invention to provide a bearing member that uses material more effectively by eliminating internal flexural stresses and increasing bearing area by increasing internal rigidity.

These and other objects of the invention will be fully understood from the following description of the invention on reference to the illustrations appended hereto.

DESCRIPTION OF THE PREFERRED EMBODIMENTS

While for convenience of reference herein use of the bearing blocks of the present invention will be discussed in the context of a preferred use of the bearing block in securement of mine roofs. The bearing block is also employable in a number of construction uses such as in tunneling or rock cuts, for example, and reference herein to a "mine roof bearing block" shall be deemed to encompass such construction uses.

Figure 1:
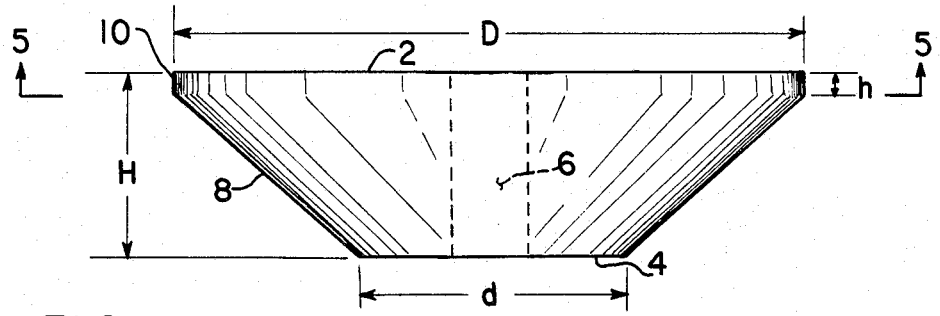
FIG. 1 is a front elevational view of a form of bearing block of the present invention.
Figure 2:
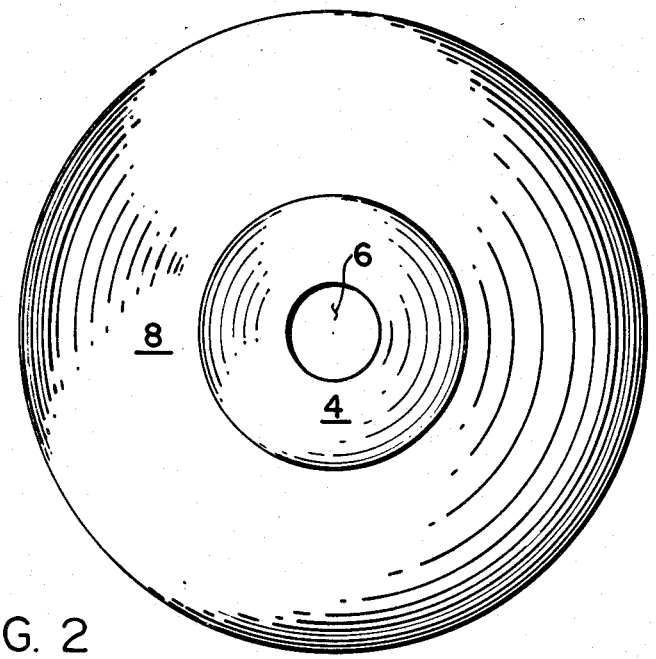
FIG. 2 is a bottom plan view of the bearing block of FIG. 1.
Figure 3:
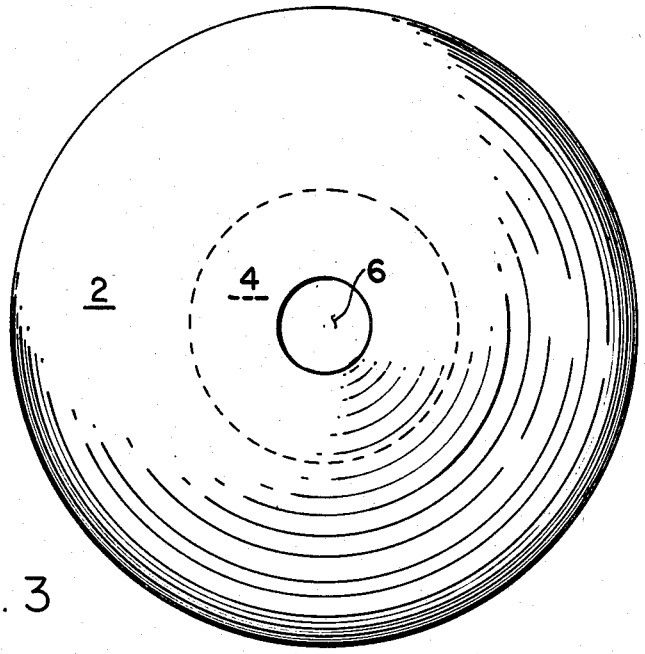
FIG. 3 is a top plan view of the bearing block of FIG. 1.

Referring now more specifically to FIGS. 1 through 3 a first embodiment of a form precast bearing plate of the present invention will be considered. In this embodiment, the bearing block has a substantially flat upper bearing surface 2 and a substantially flat lower bearing surface 4, which bearing surfaces 2, 4 are preferably substantially planar and substantially parallel to each other. A lateral surface 8 ooperates with the bearing surfaces 2, 4 to provide a frustoconical shape for the bearing block. In the form illustrated, a portion of the lateral surface 8 disposed closest to the upper bearing surface 2 has a cylindrical configuration 10 in order to avoid providing sharp edges at the perimeter of the upper bearing surface 2. For convenience of reference herein, such a configuration will be regarded as being "substantially frustoconical". The block, in this form, tapers generally downwardly and inwardly.

The hole 6 preferably extends through the central axis of the body and extends from upper bearing surface 2 to lower bearing surface 4. This hole is of sufficient diameter to permit passage of a mine roof bolt or rock bolt therethrough and may be about 1 13/16–$\frac{3}{8}$ inches in diameter.

In the form illustrated, both the upper and lower bearing surfaces 2, 4 are of circular configuration. The upper bearing surface 2 has a diameter D which is preferably about 5 to 12 inches. The diameter d of the lower bearing surface 4 is preferably less than diameter D and greater than about 2 inches. The bearing block body has a height H of which the cylindrical portion 10 has a height h. It is preferred that the the height H of the body be about $1\frac{1}{2}$ to 3 inches.

In a preferred embodiment of the invention the bearing block will be molded out of the material such as one selected from the group consisting of Portland cement, polymer concrete, sulfur concrete, hydraulic cement, cement cementitious mortars, fiberglass, concrete and resinous plastics. Suitable reinforcement means, which will be described hereinafter, may be employed.

Figure 4:
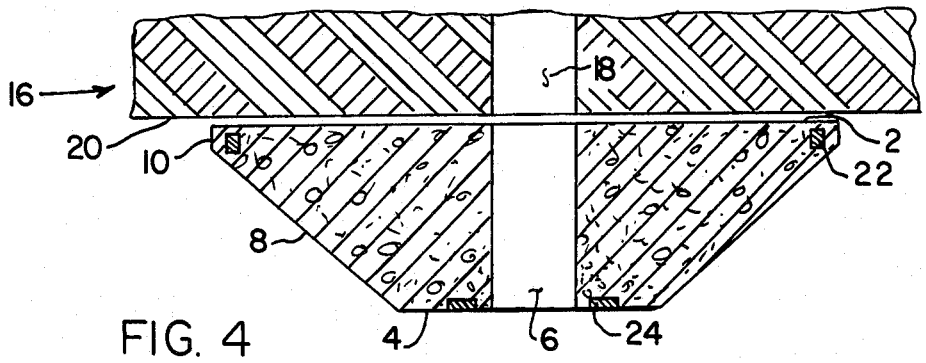
FIG. 4 is a cross-sectional illustration showing the bearing block of FIG. 1 in position adjacent a mine roof.

Referring now to FIG. 4 there is shown a segment of a mine roof 16 which is a drilled hole 18 for receipt of a roof bolt (not shown) and a downwardly exposed mine roof surface 20. (For convenience of illustration the upper bearing surface 2 of the bearing block has been shown spaced from the mine roof surface 20, but in use intimate surface to surface engagement would be provided.)

The molded material is preferably selected so as to provide high strength in compression. In order to provide appropriate tensile and shear strength within the bearing block, it is preferred that reinforcing means are provided. As is shown in FIG. 4, a steel annular member 22 which is circumferentially continuous and is generally coaxial with the central axis of the bearing block is employed. This reinforcing member 22 is preferably positioned closer to the upper bearing surface 2 than to the lower bearing surface 4 and in the preferred embodiment is disposed both closely adjacent to upper bearing surface 2 and to the lateral surface 8. In the form illustrated it is closely disposed with respect to the cylindrical portion 10 of the lateral bearing surface 8. This reinforcing means serves to improve structural integrity of the block and provides tensile strength to resist any radially outwardly directed forces which could destroy the integrity of the bearing block. It is the tensile strength of the annular member 22 which resists such fragmentation.

Referring still to FIG. 4 there is shown another reinforcing member 24 which consists of an annular steel ring which is disposed in close proximity to the hole 6 and in close proximity to the lower bearing surface 4. In the form shown in FIG. 4, reinforcing member 24 has a portion generally coplanar with surface 4. This member 24 serves to provide reinforcement for this region against localized crushing failure in situations where the bearing area under the bolt head is so small that the resulting contact stresses exceed the compressive strength of the molded material.

It will be appreciated that in the embodiment shown in FIG. 4, the bearing block is of solid construction, except for hole 6. The molded material and reinforcing means are self-bonded so as to provide a unitary structure with interaction so as to establish the desired compressive and tensile strength. For example, when the bearing block is made of concrete and the reinforcing means 22, 24 are annular steel rings, the concrete and steel will function as a unitary structure.

The roof bolt has a head disposed adjacent to the lower bearing surface and a shank. Referring still to FIG. 4, in use, a roof bolt will be introduced through hole 6 into hole 18 in the mine roof and will be tightened in such fashion that the roof bolt head or overlying washer will apply a compressive force to lower bearing surface 4. This force will be transmitted by the bearing block directly to the mine roof surface 20 with which upper bearing surface 2 is in intimate surface to surface contact. As a result of the intimacy of this relationship, coupled with the larger size of upper bearing surface 2 with respect to lower bearing surface 4, the forces applied at lower bearing surface 4 will be broadened over a greater area by the enlarged upper bearing surface 2 thereby effecting a more efficient transfer of force to apply a compressive load to the overlying roof strata. This difference in areas also serves to resist undesired crushing failure of the contacted portion of the roof surface. As a result of the efficient surface-to-surface contact between the bearing block and mine roof surface and the resistance to the undesired deflection, effective mine roof restraint is accomplished by the precast bearing blocks of the present invention.

While particular forms of reinforcing means which are preferred have been disclosed, it will be appreciated that other materials, configurations and geometric positions of reinforcing means may be provided in the block. For example, steel wire, wire mesh, steel scraps, helical springs, synthetic fibers such as glass, polymer or graphite fibers as well as other materials may be employed for reinforcement purposes.

Figure 5:
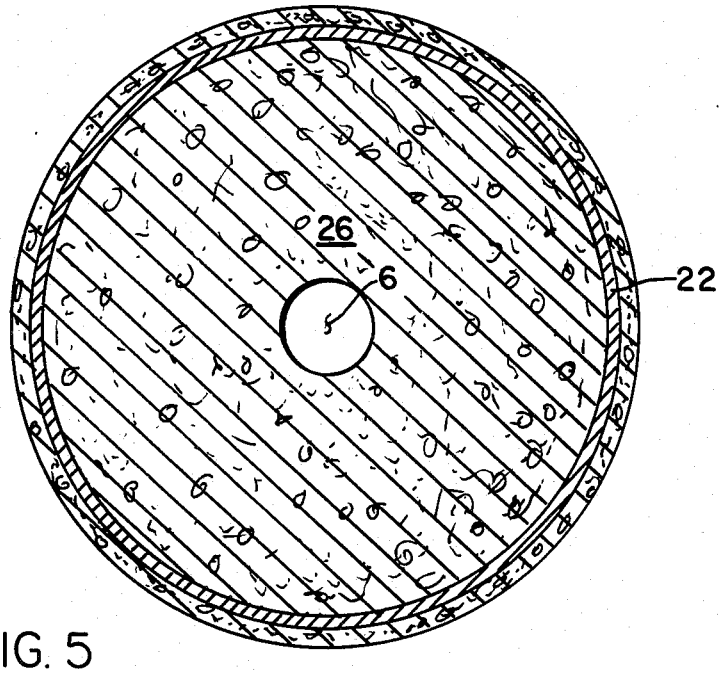
FIG. 5 is a cross-sectional illustration of the bearing block of FIG. 1 taken through 5—5.

In FIG. 5, the annular continuity of reinforcing band 22 and its interrelationship with the concrete of the interior 26 are illustrated.

Figure 6:
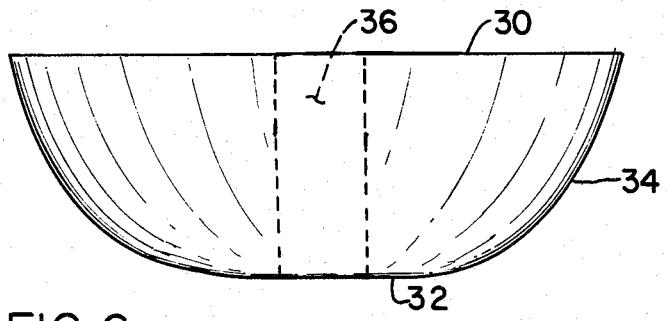
FIG. 6 is a front elevational view of a modified form of bearing block of the present invention.

Referring now to FIG. 6, a further embodiment of the invention will be considered. In this embodiment, as in the first embodiment, the upper bearing surface 30 and lower bearing surface 32 are substantially flat, generally circular and are oriented generally parallel with respect to each other. The lateral surface 34 is substantially spherical so as to provide a bearing block of generally dome shaped construction. Hole 36 is preferably positioned at the central axis of the block. The preferred dimensional relationships with respect to the diameters of the bearing surfaces 30, 32 and overall height as have been expressed hereinbefore are equally applicable to this embodiment. Suitable reinforcement would be provided.

Figure 7:
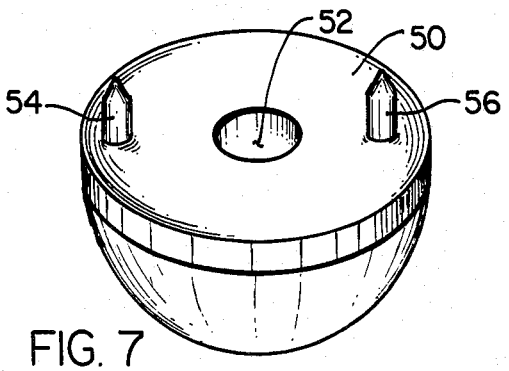
FIG. 7 is a perspective view of a modified form of upper bearing surface of the present invention.
Figure 8:
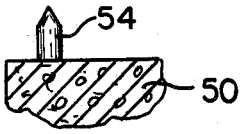
FIG. 8 is a fragmentary cross-sectional view of a portion of the upper bearing surface of FIG. 7.

Referring more specifically to FIGS. 7 and 8, a further refinement of the invention will be considered. The bearing block has an upper bearing surface 50, a generally centrally located hole 52 and integrally formed upwardly projecting stabilizer means, which in the form shown consist of a pair of pointed studs 54, 56. These studs 54, 56 project from the upper bearing surface 50. As the roof bolt is tightened, these studs 54, 56 penetrate the roof and serve to resist undesired relative lateral movement between the roof and the bearing block.

Figure 9:
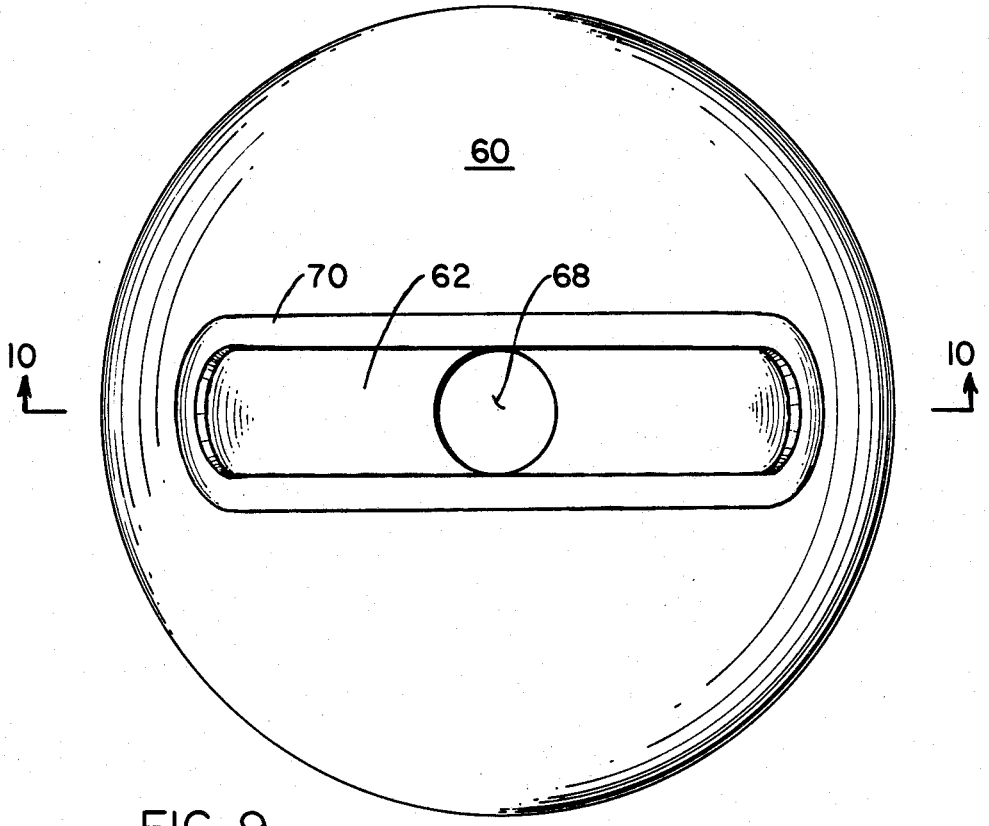
FIG. 9 is a bottom plan view of another embodiment of the bearing block of the present invention.
Figure 10:
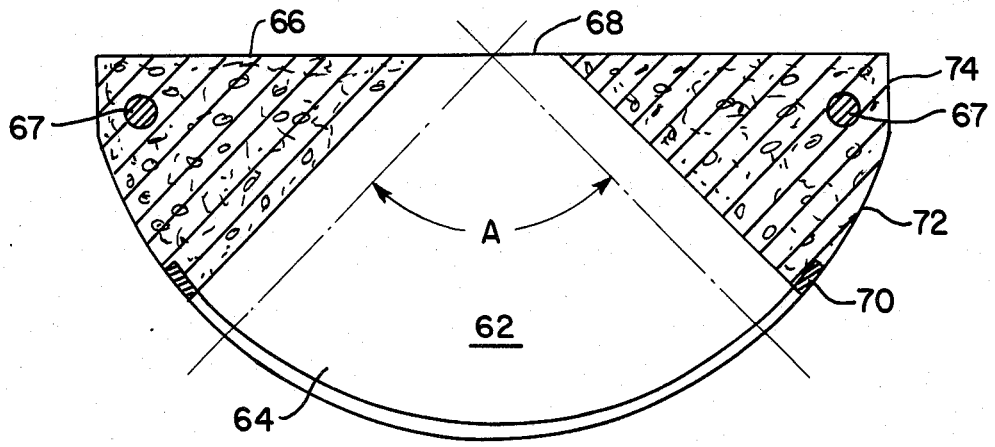
FIG. 10 is a cross-sectional illustration of the present invention taken through 10—10 of FIG. 9.
Figure 11:
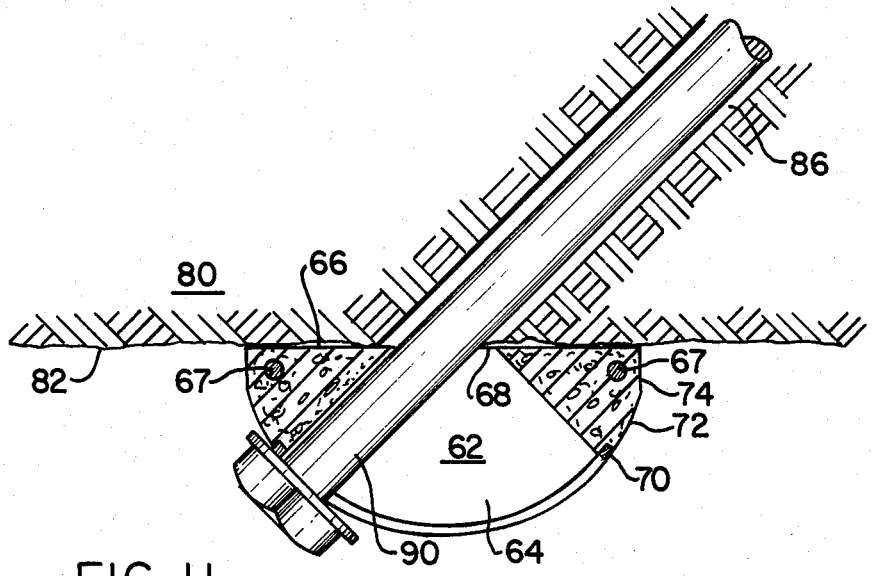
FIG. 11 is a further cross-sectional illustration of the bearing block of FIG. 9 showing it in installed position.

FIGS. 9 through 11 illustrate a further embodiment of the invention which is particularly suited for situations in which it is desired to introduce a roof bolt angularly with respect to the vertical. In this embodiment, the lower bearing surface is provided with a hole 62 which is in the form of an elongated slot 64. Adjacent to its lower end and tapers toward the upper bearing surface 66 where it is a generally circular hole 68. Suitable reinforcing member 70 which may take the form of a closed metal member, is disposed in surrounding relationship with respect to the hole 62 adjacent to lower bearing surface 60. In the form shown, it is flush with surface 60.

Lateral surface 72 is generally exteriorly convex and terminates in a generally cylindrical portion 74 which is disposed adjacent to upper bearing surface 66. This serves to provide a generally perpendicular relationship between portion 74 and upper bearing surface 66. This serves to resist undesired spalling in this region. Reinforcing means 67 in the form of an annular steel rod is provided generally adjacent to upper bearing surface 66.

In general, it is preferred that the angle A defined by the taper be about 60 to 90 degrees to permit the desired angular positioning of the roof bolt.

FIG. 11 shows the embodiment of FIGS. 9 and 10 in use. The mine ceiling 80 has roof surface 82 in contact with upper bearing surface 66. Hole 86 in the ceiling 80 is angularly oriented with respect therein and is in communication with hole 2. Roof bolt 90 extends therethrough and has a portion of its shank in contact with a lateral wall of the bearing block.

While for convenience of illustration and description herein specific reference has been made to two preferred configurations of the precast bearing block, it will be appreciated that other shapes may be employed. For example, rather than being cicular, the bearing surfaces may be polygonal. Further, the lateral surfaces may take other forms such as an ellipsoid or parabaloid, for example. Any of these shapes may be truncated adjacent to the lower bearing surface to provide an improved bearing surface for the bolt head. Also, while the preferred embodiments have a solid construction except for the bolt receiving opening, additional voids may be provided for weight reduction, for example, or other purposes, if desired.

Tests have shown the bearing block of the present invention to be in compliance with appropriate governmental specifications including ASTM Specification F 432.

It will be appreciated that the present invention has provided an effective, structurally sound and economical means of roof control through the use of a precast structure made from a molded material in combination with reinforcing means such that unitary action is achieved.

Whereas particular embodiments of the invention have been described above for purposes of illustration it will be evident to those skilled in the art that numerous variations of the details may be made without departing from the invention as defined in the appended claims.

I claim:

1. A precast mine roof supporting bearing block assembly comprising a mine roof, a molded mine roof bearing block body, said body having an upper roof surface engaging bearing surface and a lower bearing surface, said bearing surfaces being substantially parallel, said upper bearing surface being larger than said lower bearing surface, a lateral surface connecting said bearing surfaces, a hole extending through said body from one said bearing surface to the other said bearing surface, reinforcing means disposed within said molded body, said reinforcing means including first reinforcing means disposed closer to said upper bearing surface than to said lower bearing surface, roof bolt means having a head disposed adjacent to said lower bearing surface and a shank, and said roof bolt means shank being introduced into said hole adjacent to said lower bearing surface extending through said body into a hole in the mine roof and being in tension such that the roof bolt head disposed at said lower bearing surface applies a compressive force to said block.

2. The precast bearing block of claim 1 including said molded body except for said hole being substantially solid.

3. The precast bearing block of claim 2 including said hole passing generally through the central axis of said body.

4. The precast bearing block of claim 3 including said first reinforcing means being an annular reinforcing member disposed generally adjacent to said lateral surface.

5. The precast bearing block of claim 4 including said reinforcing means having second reinforcing means disposed closer to said lower bearing surface than to said upper bearing surface.

6. The precast bearing block of claim 5 including said second reinforcing means being an annular reinforcing member disposed generally in surrounding, closely adjacent relationship with respect to said hole.

7. The precast bearing block of claim 5 including said reinforcing member being made of metal.

8. The precast bearing block of claim 1 including said upper bearing surface being generally circular, and said lower bearing surface being generally circular.

9. The precast bearing block of claim 8 including said body having a generally frustoconical configuration.

10. The precast bearing block of claim 8 including said body having a generally dome shaped configuration.

11. The precast bearing block of claim 10 including said lateral surface being of generally spherical configuration.

12. The precast bearing block of claim 1 including said body being molded from a material selected from the group consisting of Portland cement, polymer concrete, sulfur concrete, hydraulic cement, cementitious mortars, fiberglass, concrete and resinous plastic.

13. The precast bearing block of claim 8 including the diameter of said upper bearing surface being about 5 to 12 inches.

14. The precast bearing block of claim 13 including the height of said body being about 1½ to 3 inches.

15. The precast bearing block of claim 14 including said body being substantially frustoconical, and a cylindrical lateral surface portion disposed adjacent to said upper bearing surface.

16. The precast bearing block of claim 2 including said body being substantially rigid.

17. The precast bearing block of claim 16 including said molded body and said reinforcing means being self-bonded into a unitary construction.

18. The precast bearing block of claim 2 including said bearing surfaces each being substantially flat.

19. The precast bearing block of claim 2 including stabilizer means projecting upwardly from said upper bearing surface.

20. The precast bearing block of claim 19 including said stabilizer means having a plurality of upwardly projecting studs.

21. The precast bearing block of claim 1 including said hole converging from said lower bearing surface toward said upper bearing surface.

22. The precast bearing block of claim 21 including said hole in the region adjacent said lower bearing surface being an elongated slot.

23. The precast bearing block of claim 22 including said hole having a pair of hole defining walls disposed at an angle of about 60 to 90 degrees with respect to each other.

24. The precast bearing block of claim 23 including reinforcement means which are provided in surrounding relationship with respect to said hole at or adjacent to said lower bearing surface.

25. The precast bearing block of claim 21 including said first reinforcing means being an annular reinforcing member disposed generally adjacent to said upper bearing surface.

* * * * *

UNITED STATES PATENT AND TRADEMARK OFFICE

CERTIFICATE OF CORRECTION

PATENT NO. : 4,618,290

DATED : October 21, 1986

INVENTOR(S) : ROGER M. HANSEN

It is certified that error appears in the above-identified patent and that said Letters Patent is hereby corrected as shown below:

Column 1, line 21, the first patent number should read --2,682,152--.

Column 3, line 10, "ooperates" should read --cooperates--.

Column 3, line 24, "3/8 inches" should be --1 3/8 inches--.

Column 3, line 40, a comma --,-- should be inserted after "cement".

Column 5, line 42, "hole 2" should be --hole 62--.

Column 5, line 49, "cicular" should be --circular--.

Signed and Sealed this

Twentieth Day of January, 1987

*Attest:*

DONALD J. QUIGG

*Attesting Officer*

*Commissioner of Patents and Trademarks*